United States Patent [19]

Reeder

[11] 4,035,753

[45] July 12, 1977

[54] CURRENT LIMITING FUSE CONSTRUCTION

[75] Inventor: Conrad M. Reeder, Chicago, Ill.

[73] Assignee: S & C Electric Company, Chicago, Ill.

[21] Appl. No.: 708,149

[22] Filed: July 23, 1976

[51] Int. Cl.[2] ..... H01H 85/02

[52] U.S. Cl. ..... 337/186; 337/248; 337/414

[58] Field of Search ..... 337/186, 201, 248, 414, 337/246, 252

[56] References Cited

U.S. PATENT DOCUMENTS

| | | | |
|---|---|---|---|
| 3,250,879 | 5/1966 | Jacobs | 337/248 |
| 3,659,244 | 4/1972 | McKeithan et al. | 337/246 X |
| 3,967,228 | 6/1976 | Koch et al. | 337/248 |

FOREIGN PATENT DOCUMENTS

| | | | |
|---|---|---|---|
| 1,293,316 | 4/1969 | Germany | 337/248 |

*Primary Examiner*—George Harris
*Attorney, Agent, or Firm*—Kirkland & Ellis

[57] ABSTRACT

An integrally molded current limiting fuse body having surface elongating skirts integrally molded thereto to increase the surface leakage distance may be used in conjunction with various types of end closures for one or both of ends of the fuse body. One type of end closure utilizes a flange member integrally molded around the exterior edge of the fuse body so that an extending edge may be folded over an end plate overlying the open end of the fuse body. Another type of end closure comprises a flange member integrally molded into the edge of the open end of the fuse body so that an extended edge extending beyond the open end of the fuse body can be folded over an end plate overlying the open end of the fuse body. Alternatively, the extended edge of the flange member may be welded to the edge of the end plate to securely seal the end plate over the open end of the fuse body. When necessary, a seal may be placed between the end of the fuse body and the end plate to prevent the admission of moisture. Another end closure comprises a metallic end cap having an end wall portion and a flange portion joined to the edge of the end wall portion. The flange portion is integrally molded into the edge of the open end of the fuse body so that the end wall portion overlies and seals the open end of the fuse body.

13 Claims, 9 Drawing Figures

20
37
48
34
35
32

42
37
48
34
46
44
40

60
62
76
74
75
72
70
52
54
56
59

60
62
76
74
75

82
76
74
84
80
86

CURRENT LIMITING FUSE CONSTRUCTION

BACKGROUND OF THE INVENTION

1. Field of the Invention

The present invention relates to high voltage current limiting fuses, and more specifically, the present invention relates to unique construction of end closures for current limiting fuses.

2. Description of the Prior Art

High voltage current limiting fuses are well known in the art. For example, U.S. Pat. Nos. 3,648,211 — McKeithan; 3,345,483 — Leonard et al.; 3,309,447 — Bronikowski; and 2,917,605 — Fahnoe all disclose various types of high voltage current limiting fuse constructions. Further, the assignee of the present application is also the assignee of other co-pending patent applications which relate to various aspects of high voltage current limiting fuse constructions namely, Ser. Nos. 633,373, filed Nov. 19, 1975; 633,488, filed Nov. 19, 1975; 633,487, filed Nov. 19, 1975; and 456,866, filed Apr. 1, 1974 now issued as U.S. Pat. No. 3,893,056.

Construction of high voltage current limiting fuses is difficult and often expensive because the forces generated during fuse operation require a sturdy well-constructed fuse body that will withstand these operational forces. Further, since such fuses are often mounted outdoors, and consequently are subject to weather, pollution, and contamination conditions, special care and attention must be taken to assure that such high voltage current limiting fuses will neither leak moisture into the exterior thereof nor be subject to external flash-over during or after fuse operation as a result of surface contamination or weather conditions.

Accordingly, it would be a desirable advance in the art to provide high voltage current limiting fuse construction which permits relatively simple, inexpensive manufacturing techniques, while preserving the requisite strength and surface leakage characteristics necessary for proper fuse operation.

BRIEF DESCRIPTION OF THE INVENTION

The present invention constitutes an improvement in current limiting fuses. Such current limiting fuses conventionally include a current responsive fusible element consisting of one or more conductive filaments electrically connected in parallel, a support member for supporting the fusible element, and first and second mounting studs respectively electrically connected to opposite ends of the fusible element.

The improvements comprise an integrally molded hollow fuse body surrounding the fusible element and the support member having exterior surface elongating means integrally molded thereto. An end sealing means is provided for closing at least one open end of the fuse body. One embodiment of the end sealing means comprises a flange member integrally molded around the exterior edge of the at least one open end of the fuse body so that an extended edge of the flange member extends beyond the edge of the at least one open end of the fuse body. An end plate dimensioned to fit over the at least one open end of said fuse body so that an edge thereof is adjacent the flange member is retained over the at least one open end of the fuse body by folding the extended edge of the flange member over the edge of the end plate.

Another embodiment of the end sealing means comprises a flange member integrally molded into the edge of the at least one open end of fuse body so that an extended edge extends beyond the at least one open end of the fuse body. An end plate is dimensioned to fit over the at least one open end of the fuse body so that an edge thereof is adjacent the flange member. The end plate is retained over the at least one open end of the fuse body by the extended edge of the flange member being folded over the edge of the end plate.

Alternatively, the flange member may be welded to the end plate to securely fasten it over the at least one open end of the fuse body, and if additional sealing is required, a seal may be positioned between the end plate and the fuse body to prevent the admission of moisture.

Another embodiment of the end sealing means in accordance with the present invention comprises a metallic end cap having an end wall portion and a flange portion joined to the edge of the end wall portion. The flange portion is molded into the edge of the at least one open end of the fuse body so that the end wall portion overlies and seals the at least one open end.

In each of the embodiments, the flange may be coated with a resilient coating before molding to improve adhesion between the flange and the fuse body and to relieve stress due to dimensional changes resulting from different coefficients of thermal expansion.

Accordingly, it is a primary object of the present invention to provide improved construction of high voltage current limiting fuses which permit easy economical fabrication thereof.

Yet another object of the present invention is to provide a high voltage current limiting fuse having improved closures which are economical to fabricate and easy to assemble.

Yet another object of the present invention is to provide a high voltage current limiting fuse with an integrally molded fuse body having surface elongating means in the form of skirts integrally molded thereto.

These and other objects, advantages, and features of the present invention shall hereinafter appear, and for the purposes of illustration, but not for limitation, exemplary embodiments of the present invention are illustrated in the accompanying drawings.

DETAILED DESCRIPTION OF THE PREFERRED EMBODIMENTS

Figure 1:
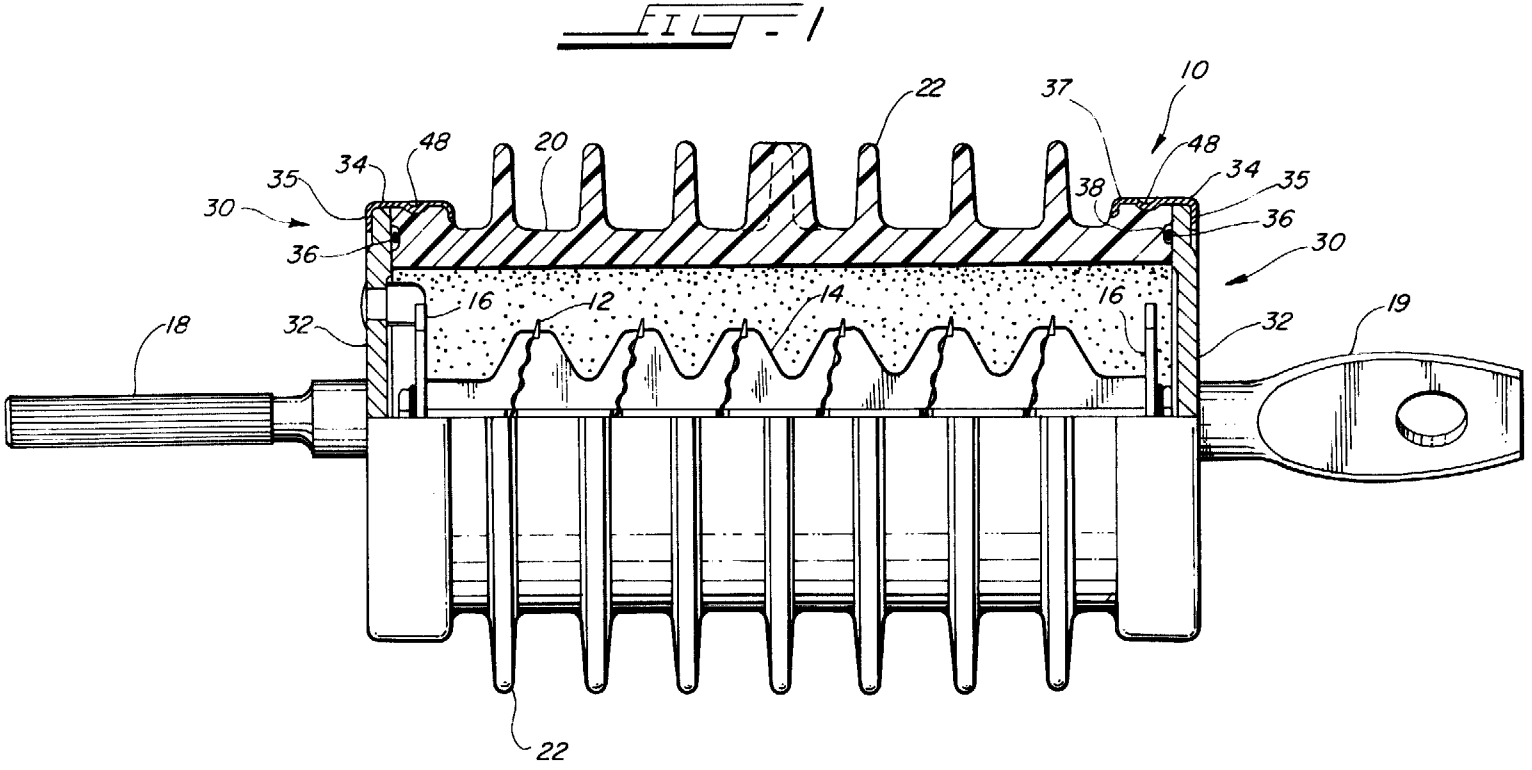
FIG. 1 is a side, partially cross-sectional view of one embodiment of the present invention.

With reference to FIG. 1, high voltage current limiting fuse 10 comprises a fusible element 12 that is helically wound around a support member 14. Mounted on each end of support member 14 are metallic terminators 16 which are electrically connected to the ends of fusible element 12. Terminators 16 are electrically connected to mounting studs 18 and 19 so that an electrical circuit is completed through the fuse. Fusible element 12 is formed of a material that is meltable when a predetermined amount of current is exceeded. Support member 14 and terminators 16 may be fabricated in any conventional manner. However, the support member and terminators illustrated herein for each of the FIGS. 1–8 embodiments are substantially the same as that disclosed in co-pending patent application Ser. Nos. 633,486, filed Nov. 19, 1975 and 633,293, filed Nov. 19, 1975 which are assigned to the same assignee as the present invention.

Mounted around fusible element 12 and support member 14 is an integrally molded fuse body 20. Annular skirts 22 are integrally molded to fuse body 20, and skirts 22 extend completely around fuse body 20. Fuse body 20 may be formed from any moldable, electrically insulating material which is water resistant, impervious to moisture, and physical strong. Suitable materials for the fabrication of fuse body 20 are epoxy resin and polyester resin, and both may be modified by various fillers and fiber reinforcing materials.

Mounted to each end of fuse body 20 is an end closure assembly 30 comprising metallic end plate 32 and flange member 34. End plate 32 is dimensioned to overlie the open end of fuse body 20 and an O-ring seal 36 in a recess 38 in the end of fuse body 20 provides a moisture impervious seal. Mounting studs 18 and 19 are attached to end plate 32 by welding or any other suitable means.

Figures 2, 3, 4, 5, 5A:
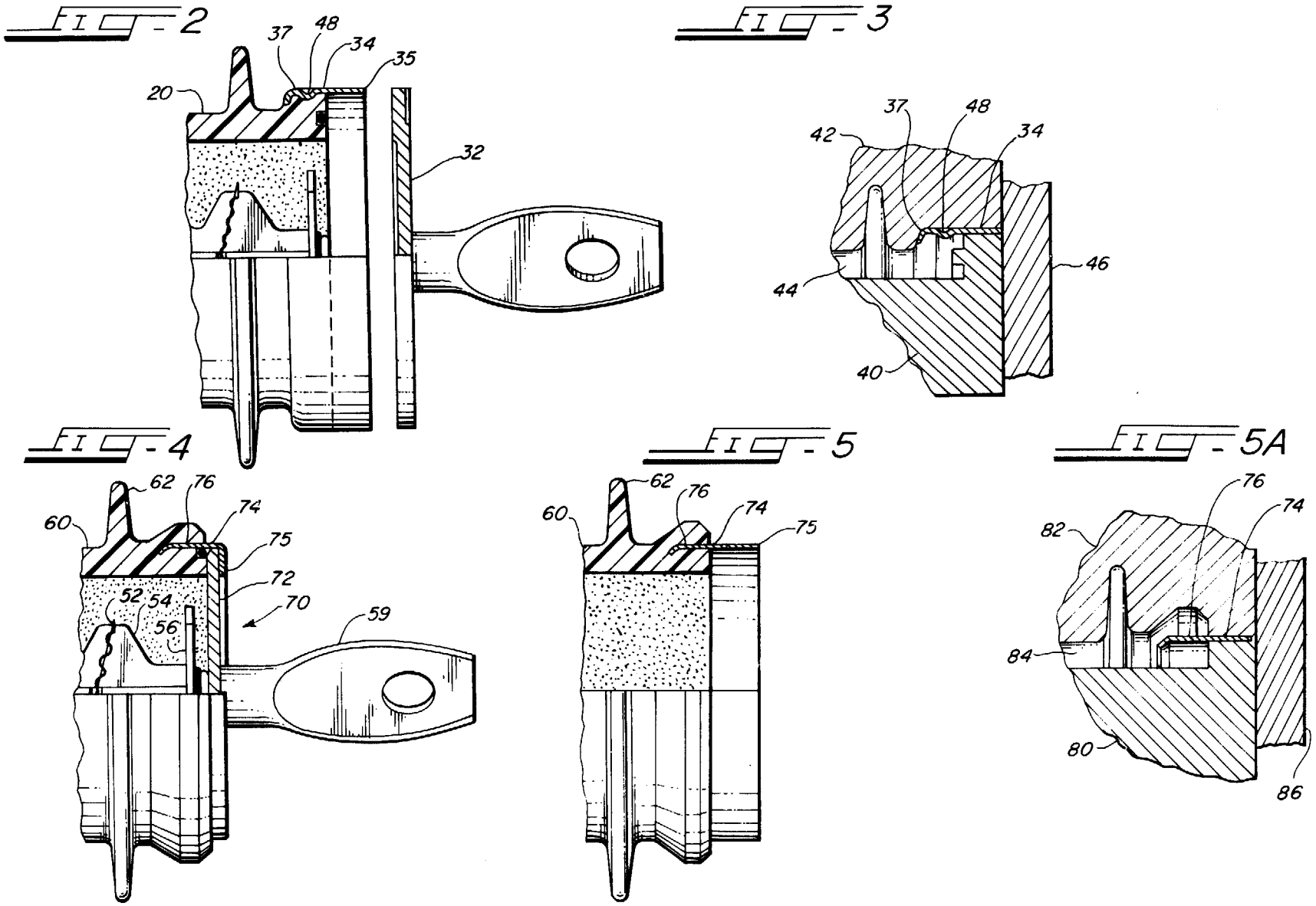
FIG. 2 is a side, partially cross-sectional partially fragmentary view of the embodiment illustrated in FIG. 1 prior to assembly thereof.
FIG. 3 is a side, partially cross-sectional, partially fragmentary view of a typical molding arrangement showing how the FIG. 1 embodiment would be molded.
FIG. 4 is a side, partially cross-sectional, partially fragmentary view of yet another embodiment of the present invention.
FIG. 5 is a side, partially cross-sectional, partially fragmentary view of the FIG. 4 embodiment prior to assembly thereof.
FIG. 5A is a side, partially cross-sectional, partially fragmentary view of a typical molding arrangement showing how the FIG. 4 embodiment would be molded.

Flange member 34 is attached around the end of fuse body 20 by molding the end of fuse body 20 within flange member 34. With reference to FIG. 3, during molding flange member 34 is positioned between mold sections 40 and 42 which are formed so as to provide a mold cavity 44 therebetween in which fuse body 20 can be molded when a suitable plastic resin molding material is injected and allowed to cure. A mold support 46 supports and seals mold sections 40 and 42, and also retains flange member 34 in position. When the plastic resin material (such as epoxy resin and polyester resin) is inserted into mold cavity 44, flange member 34 becomes integrally molded about the end of fuse body 20.

With reference to FIG. 2, the end of a completed fuse body 20 is illustrated having flange member 34 molded thereon. Flange 34 has an extended edge 35 which extends beyond the end of fuse body 20 prior to assembly with end plate 32. Indentations 48 are spaced around flange member 34 to assist in the bonding of flange 34 to fuse body 20 and to prevent flange 34 from being able to be rotated about the end of fuse body 20. A thin resilient coating 37 may be applied to flange member 34 before molding in order to improve the adhesion between flange member 34 and the material of fuse body 20, and also to help relieve any stress due to dimensional change in the materials as a result of, for example, different coefficients of thermal expansion.

To assemble end closure assembly 30, end plate 32 is merely inserted within the extended edge 35 of flange member 34 and the extended edge 35 is folded over as illustrated in FIG. 1. This folding process may be accomplished by any suitable or convenient manner such as by magnetic pulse forming or by a rolling operation using an expanding mandrel. Because flange member 34 is integrally molded around the end of fuse body 20, there is no necessity for the forming or rolling operation to exert any force whatsoever around the end of fuse body 20. Therefore, the possibility that fuse body 20, which is a relatively hard material, may be cracked or chipped during the sealing operation is substantially eliminated since only the extended edge 35 receives any force during the folding operation.

With reference to FIG. 4, an alternative embodiment of the present invention is illustrated. This embodiment is similar to the embodiment illustrated in FIG. 1. A fusible element 52 is mounted on a support member 54, and terminator 56 is mounted on the end of the support member and electrically connected to the fusible element 52. An integrally molded fuse body 60 is positioned around fusible element 52 and support member 54. Fuse body 60 is substantially the same as that illustrated in FIG. 1 (except as hereinafter indicated) and has integrally molded skirts 62 extending around the periphery thereof.

Mounted over the end of fuse body 60 is an end closure assembly 70 comprising a metallic end plate 72 and a flange member 74. A mounting stud 59 is mounted to end plate 72. Only one end of fuse body 60 is illustrated in FIG. 4 so only one end closure assembly is shown. A similar end closure could be used on the opposite end of fuse body 20, or any other suitable closing means could be utilized.

With reference to FIG. 5A, illustrated are mold sections 80 and 82 between which is formed a mold cavity 84 which is dimensioned to form fuse body 60. Flange member 74 is held between molds 80 and 82 and a mold support 86 retains flange member 74 and seals the edge of the molds 80 and 82. A suitable molding material such as epoxy resin or polyester resin may be injected into mold cavity 84 to form fuse body 60. After the material has cured and molds 80 and 82 have been removed, fuse body 60 and flange member 74 appear as illustrated in FIG. 5, with flange member 74 having an extended edge 75 extending outwardly from the end of fuse body 60. Assembly techniques can be substantially the same as those described with respect to the FIG. 1 embodiment as illustrated in FIG. 4 so that the extended edge 75 is folded over the edge of end plate 72 to provide a sturdy rugged seal over the open end. A thin resilient coating 76 may be applied prior to molding to improve adhesion between flange member 74 and the material of fuse body 60 and also to help relieve any stresses that may occur due to dimensional changes resulting from different coefficients of thermal expansion.

However, the arrangement illustrated in FIG. 5 is also suitable for use with a different type of closing arrangement. Specifically, with reference to FIG. 6, an end plate 90 may be used which has an end wall portion 92 which overlies the open end of fuse body 60 and an annular flange 94 which is dimensioned to lie adjacent to flange member 74 so that the extended edge 75 of flange member 74 can be welded to flange 94 by weld 96 around the edges thereof to seal and lock the end plate 90 over the end of fuse body 60. A typical mounting stud 98 can be attached to end plate 90 by any suitable means.

Figure 7:
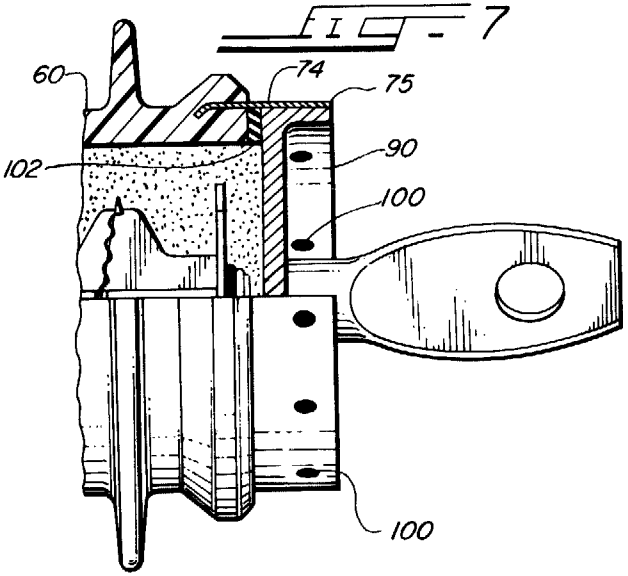
FIG. 7 is a side, partially cross-sectional, partially fragmentary view of another embodiment of the present invention.
Figure 6:
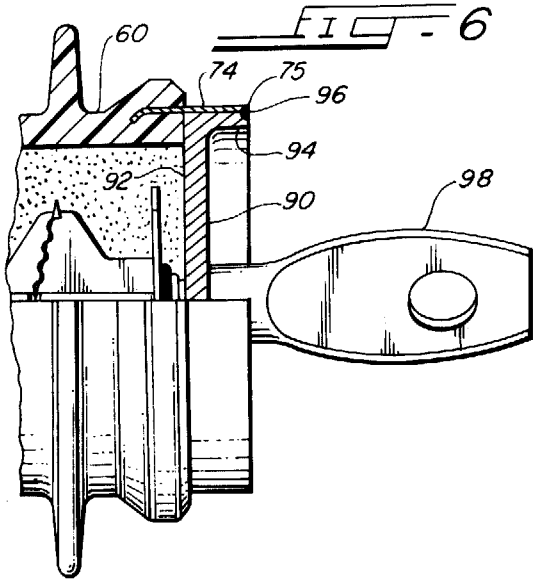
FIG. 6 is a side, partially cross-sectional, partially fragmentary view of yet another embodiment of the present invention.

FIG. 7 illustrates yet another sealing technique utilizing the arrangement illustrated in FIGS. 5 and 6. In this arrangement, end plate 90 is merely spot welded at a number of spot welds 100 to the extended edge 75 of flange member 74, and a moisture impervious seal 102 is positioned between end plate 90 and fuse body 60 to assure that moisture does not enter into the fuse body 60.

Figure 8:
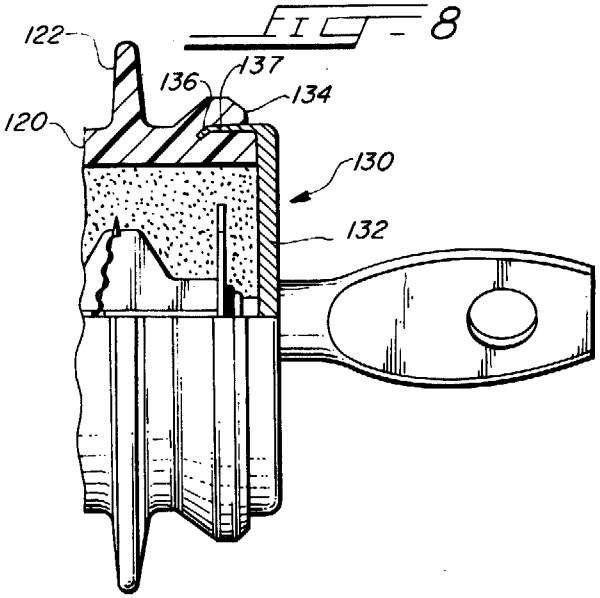
FIG. 8 is a side, partially cross-sectional, partially fragmentary view of yet another embodiment of the present invention.

FIG. 8 illustrates yet another embodiment of a closing means in accordance with the present invention. In the FIG. 8 embodiment, an integrally molded fuse body 120 has integrally molded skirts 122 extending around the periphery thereof to increase the surface leakage distance of the fuse. Fuse body 120 is molded from any suitable molding material such as epoxy or polyester resin.

Integrally molded into the end of fuse body 20 is a metallic end cap 130 which comprises a flat end wall portion 132 and a flange portion 134 formed around the edge of the flat end wall portion and extending approximately perpendicularly thereto. Flange portion 134 is integrally molded into the end of fuse body 120 and a curved lip 136 on the end of flange portion 134 assures that metallic end cap 130 cannot be pulled out of the end of fuse body 120 as a result of normal mounting stresses. A thin resilient coating 137 may be applied to flange portion 134 in order to improve adhesion between the flange portion 134 and the material of fuse body 120 and also to help relieve any stresses that may occur due to dimensional changes resulting from different coefficients of thermal expansion.

For obvious reasons, the arrangement illustrated in FIG. 8 can only be utilized on one end of a current limiting fuse. The interior mold section would have to be withdrawn from the interior of the fuse body 120 from the opposite end which would preclude a similar end cap from being applied simultaneously at the opposite end. However, any of the end closures previously illustrated in FIGS. 1, 4, 6, or 7 could be utilized at the opposite end of fuse body 120 in conjunction with the end closures illustrated in FIG. 8.

The principal advantages of the end closures illustrated and described herein are that each of the end closures provide a water tight, mechanically strong seal that may be assembled without serious risk of cracking the fuse body during the assembly process. Further, in each of the arrangements illustrated herein, the assembly process is relatively fast and simple compared to prior art techniques. Thus, the assembly time and the cost of manufacture of the current limiting fuse is substantially reduced.

It should be expressly understood that various changes, alterations, or modifications of the structure illustrated in the foregoing embodiments may be made without departing from the spirit and scope of the present invention as defined in the appended claims.

I claim:

1. In a high voltage fuse including a current responsive fusible element, and, first and second conductive terminals respectively electrically connected to opposite ends of the fusible element; an improvement comprising:

molded hollow fuse body surrounding the fusible element;

end sealing means for closing at least one open end of said fuse body comprising:

a metallic flange member mounted to the at least one open end of said fuse body by molding when said fuse body is molded, said flange member having an extended edge extending beyond the at least one open end of said fuse body;

a metallic end plate dimensioned to fit over the at least one open end of said fuse body so that an edge thereof is adjacent said flange member, said end plate being held over the at least one open end of said fuse body by said extended edge of said flange member being folded over the edge of said end plate.

2. An improvement, as claimed in claim 1 wherein said fuse body has exterior surface elongating means integrally molded thereto.

3. An improvement, as claimed in claim 1, wherein a seal is positioned between said end plate and said fuse body to prevent admission of moisture into said fuse body.

4. An improvement, as claimed in claim 1, wherein said flange member has a resilient coating thereon to improve adhesion between said flange member and said fuse body and to relieve stress due to dimensional change.

5. An improvement, as claimed in claim 1, wherein said flange member is integrally molded into the edge of the at least one open end of said fuse body.

6. An improvement, as claimed in claim 1, wherein said flange member is mounted to said fuse body by having said fuse body molded within said flange member.

7. In a high voltage fuse including a current responsive fusible element, and, first and second conductive terminals respectively electrically connected to opposite ends of the fusible element; an improvement comprising:

a molded hollow fuse body surrounding the fusible element;

end sealing means for closing at least one open end of said fuse body comprising:

a metallic flange member integrally molded into the edge of the at least one open end of said fuse body when said fuse body is molded, said flange member having an extended edge extending beyond the at least one open end of said fuse body;

a metallic flange member integrally molded into the edge of the at least one open end of said fuse body so that an edge thereof is adjacent said flange member, said end plate being held over the at least one open end of said fuse body by welding said extended edge of said flange member to the edge of said end plate.

8. An improvement, as claimed in claim 7, wherein said fuse body has exterior surface elongating means integrally molded thereto.

9. An improvement, as claimed in claim 7, wherein a seal is positioned between said end plate and said fuse body to prevent admission of moisture.

10. An improvement, as claimed in claim 7, wherein said flange member has a resilient coating thereon to improve adhesion between said flange member and said fuse body and to relieve stress due to dimensional change.

11. In a high voltage fuse including a current responsive fusible element, and, first and second mounting studs respectively electrically connected to opposite ends of the fusible element; an improvement comprising:

a molded hollow fuse body surrounding the fusible element;

end sealing means for closing at least one open end of said fuse body comprising:

a metallic end cap having an end wall portion and a flange portion joined to the edge of the end wall portion, said flange portion being molded into the edge of the at least one open end of said fuse body when said fuse body is molded so that said end wall portion overlies and seals said at least one open end.

12. An improvement, as claimed in claim 11, wherein said fuse body has exterior surface elongating means integrally molded thereto.

13. An improvement, as claimed in claim 11, wherein said flange portion has a resilient coating thereon to improve adhesion between said flange member and said fuse body and to relieve stress due to dimensional change.

* * * * *